US008410038B2

(12) United States Patent
Davister et al.

(10) Patent No.: US 8,410,038 B2
(45) Date of Patent: Apr. 2, 2013

(54) ACIDIC CLEANING COMPOSITIONS COMPRISING A POLYMER

(75) Inventors: Michele Davister, Villers le Bouillet (BE); Nathalie Dastbaz, Fleron (BE); Alain Jacques, Blegny (BE); Germaine Zocchi, Villers aux Tours (BE)

(73) Assignee: Colgate-Palmolive Company, New York, NY (US)

( * ) Notice: Subject to any disclaimer, the term of this patent is extended or adjusted under 35 U.S.C. 154(b) by 37 days.

(21) Appl. No.: 12/810,978

(22) PCT Filed: Dec. 28, 2007 (Under 37 CFR 1.47)

(86) PCT No.: PCT/US2007/089042

§ 371 (c)(1), (2), (4) Date: Oct. 4, 2010

(87) PCT Pub. No.: WO2009/085049

PCT Pub. Date: Jul. 9, 2009

(65) Prior Publication Data

US 2011/0061680 A1 Mar. 17, 2011

(51) Int. Cl.
*C11D 1/04* (2006.01)

(52) U.S. Cl. ..... 510/191; 510/238; 510/475; 510/477; 510/488

(58) Field of Classification Search ..... 510/191, 510/238, 475, 477, 488
See application file for complete search history.

(56) References Cited

U.S. PATENT DOCUMENTS

| | | | | |
|---|---|---|---|---|
| 4,587,030 | A | 5/1986 | Casey | |
| 4,749,508 | A | 6/1988 | Cockrell, Jr. et al. | |
| 5,364,551 | A | 11/1994 | Lentsch et al. | |
| 5,462,697 | A | 10/1995 | Yianakopoulos | |
| 6,153,572 | A | 11/2000 | Stamm | |
| 6,593,279 | B2 | 7/2003 | Von Krosigk et al. | |
| 6,664,218 | B1 | 12/2003 | Dastbaz et al. | |
| 7,186,676 | B2 | 3/2007 | Boone et al. | |
| 7,318,871 | B2 * | 1/2008 | Egan et al. | 134/42 |
| 7,811,387 | B2 * | 10/2010 | Scialla et al. | 134/25.2 |
| 2003/0083223 | A1 | 5/2003 | Aubay et al. | |
| 2005/0215448 | A1 | 9/2005 | Evers et al. | |
| 2006/0035808 | A1 | 2/2006 | Ahmed et al. | |
| 2006/0128585 | A1 * | 6/2006 | Adair et al. | 510/383 |
| 2006/0217286 | A1 | 9/2006 | Geoffroy et al. | |
| 2007/0086971 | A1 | 4/2007 | Diet et al. | |

FOREIGN PATENT DOCUMENTS

| | | | |
|---|---|---|---|
| EP | 0467472 | | 1/1992 |
| EP | 0919610 | | 6/1999 |
| EP | 1845152 | A1 * | 10/2007 |
| WO | WO 2007/022235 | | 2/2007 |

OTHER PUBLICATIONS

International Search Report and Written Opinion for International Application No. PCT/US2007/089042 mailed Oct. 6, 2008.

* cited by examiner

*Primary Examiner* — Gregory Webb
(74) *Attorney, Agent, or Firm* — Michael F. Morgan

(57) ABSTRACT

The present invention is directed, in certain embodiments, to compositions useful for the removal of grease, lime scale, soap scum, feces, rust or other soils from surfaces such as those found in bathrooms, toilets and kitchens. Methods of removing soils and preventing soil adhesion are also contemplated.

19 Claims, No Drawings

ACIDIC CLEANING COMPOSITIONS COMPRISING A POLYMER

BACKGROUND OF THE INVENTION

Cleaning compositions for use on hard surfaces are known in the art. Hard surfaces include household surfaces such as those typically found in bathrooms and kitchens, and include a variety of different materials such as enamel, ceramic, porcelain and the like. Such surfaces include fixtures such as countertops, appliances (e.g., refrigerators, stoves) as well as bathtubs, sinks, and toilets.

Acidic cleansers are known that purport to provide activity against mineral deposits, e.g., lime scale or soap scum. Some of these cleaners are marketed as being useful for limescale and rust removal, and are said to be dependent upon a certain pH range to retain the desired activity.

However, an ongoing need exists for improved hard surface cleaners that are effective at removing limescale, soap scum, rust, and other soil deposits from bathroom surfaces. In particular, cleaning compositions that are useful as toilet bowl cleaners ("TBCs") are desirable. Because consumers are often reluctant to scrub toilet surfaces, cleaning compositions that are effective at removing solid and visible deposits such as soil and limescale from toilet bowls while requiring little or no follow-up scrubbing or wiping are especially desirable.

SUMMARY OF THE INVENTION

A cleaning composition comprising:

(a) an organic acid;

(b) a nonionic surfactant comprising an ethoxylated alcohol; and (c) a hydrophilic polymer that adsorbs to hard surfaces.

A composition useful for cleaning a bathroom or kitchen surface, comprising:

(a) lactic acid and phosphoric acid in a weight ratio of about 1:3 to about 3:1;

(b) a nonionic surfactant comprising a $C_9$-$C_{11}$ alcohol with a degree of ethoxylation of about 7.5 to about 8.1;

(c) about 0.1 to about 1% of an anti-adhesion polymer comprising a polybetaine;

(d) optionally a thickener chosen from xanthan gum, gellan gum, carrageenan gum, hydroxyethylcellulose; and (e) about 85 to about 95% water;

wherein the pH of the composition is 0 to about 3.

A composition useful for cleaning a bathroom or kitchen surface, comprising:

(a) oxalic acid and formic acid in a weight ratio of about 1:2 to about 1:5;

(b) a nonionic surfactant comprising a $C_9$-$C_{11}$ alcohol with a degree of ethoxylation of about 7.5 to about 8.1;

(c) about 0.1 to about 1% of an anti-adhesion polymer comprising a polybetaine;

(d) optionally a thickener chosen from xanthan gum, gellan gum, carrageenan gum, hydroxyethylcellulose; and (e) about 85 to about 95% water;

wherein the pH of the composition is 0 to about 3.

DETAILED DESCRIPTION OF THE INVENTION

As used throughout, ranges are used as a shorthand for describing each and every value that is within the range. Any value within the range can be selected as the terminus of the range. Furthermore, all references cited herein are hereby incorporated by reference in their entireties. However, in the event of a conflict between a definition in the present disclosure and one in a cited reference, the present disclosure controls.

The compositions as provided herein are described and claimed with reference to their ingredients, as is usual in the art. As would be evident to one skilled in the art, the ingredients may in some instances react with one another, so that the true composition of the final formulation may not correspond exactly to the ingredients listed. Thus, it should be understood that the invention extends to the product of the combination of the listed ingredients.

In certain embodiments, the present invention is directed to a composition that is useful for the cleaning or disinfecting of hard surfaces such as those typically found in bathrooms and kitchens, especially enamel, glass, metal, hard plastic, tile, glass, porcelain or ceramic surfaces, such as bathtubs, sinks, countertops and toilets. Other hard surfaces for which the compositions of the present invention may be useful include, e.g., metals such as stainless steel, and natural or synthetic minerals such as granite.

In various embodiments, the compositions of the present invention may be useful for the removal of soils such as, for example, grease, lime scale, soap scum, feces, rust or other soils. In certain embodiments, a composition of the present invention is an aqueous solution comprised of an organic acid, together with a nonionic surfactant, a thickener and an anti-adhesion polymer.

In various embodiments, the invention is also directed to methods for removing stains, e.g., those resulting from lime scale, soap scum, grease, feces or rust, from a hard surface, comprising applying the composition to the hard surface, and rinsing the composition, e.g., with water, or wiping off the composition, e.g., with a sponge, towel, brush or other implement.

The compositions of the present invention comprise an organic acid. In certain embodiments, one or more organic acids may be present. In certain embodiments the compositions may further comprise an inorganic acid. Organic acids that are useful for the present embodiments may include, for example, acetic acid, lactic acid, citric acid, levulinic acid, tartaric acid, formic acid, glycolic acid, adipic acid, succinic acid, glutaric acid, maleic acid, methane sulfonic acid, sulfamic acid and oxalic acid. Inorganic acids are optional for the present invention and may include, for example, sulfuric acid, nitric acid, hydrochloric acid or phosphoric acid.

In various embodiments, at least one organic acid is lactic acid in an amount of about 2 to about 6% of the composition. In certain embodiments, the compositions may comprise two or more organic acids, or a combination of organic and inorganic acids, for example, formic and oxalic acids in a weight ratio of about 2:1 to about 5:1, or lactic acid and phosphoric acid in a weight ratio of about 1:3 to about 3:1.

In various embodiments, the compositions of the present invention are such that the total amount of acid present (including both organic and inorganic acids) is about 4 to about 7.5% of the composition, about 4.5 to about 7% of the composition, or about 4.75 to about 6.75% of the composition.

In various embodiments, the compositions of the present invention may further comprise a hydrophilic polymer that adsorbs to hard surfaces, i.e., an anti-adhesion polymer. As used herein, the term "anti-adhesion polymer" refers to a polymer that prevents the adhesion of soils to a hard surface, either by creating a physical barrier impeding soils sticking to the surface or allowing a better flowing of the soil from the surface. In certain embodiments, the anti-adhesion polymer may be an amphoteric polymer, and/or may be a hydrophilic polymer.

In certain embodiments, the anti-adhesion polymer may comprise a polybetaine. For example, useful polymers that may be included in the compositions of the present invention are those polymers available under the tradename "Mirapol Surf S-500" or "Mirapol Surf-S 110" from Rhodia, Inc. (Tennessee, USA), and may be further described in U.S. Patent Application Publication No. 2006/0217286 to Geoffrey et al. Other useful polymers include, for example, a polymeric quaternary ammonium salt consisting of acrylamide and dimethyl dialkyl ammonium chloride monomers, also known as Polyquaternium-7 and available, for example, under the tradename "Merquat 550" from Nalco Company (Illinois, USA); or water-soluble polymers such as those available under the trade name "Sokalan" from BASF Company (New Jersey, USA).

In certain embodiments, the anti-adhesion polymer may be a polyacrylate polymer. In certain embodiments, amphoteric polyamines have been found to be useful as anti-adhesion polymers, such as those available under the trade name "Sokalan" and available from BASF (New Jersey, USA). These include, for example, "Sokalan HP 70," or polycarboxylates such as maleic acid/olefin copolymers such as those available under the trade name "Sokalan CP 9" from BASF or "Acusol 460 NK (available from Rohm & Haas (Pennsylvania, USA).

The compositions of the present invention comprise a nonionic surfactant. Examples of nonionic surfactants useful for the present invention include the alkoxylated alcohol nonionic surfactants, for example, primary aliphatic alcohol ethoxylates, secondary aliphatic alcohol ethoxylates, alkylphenol ethoxylates and ethylene-oxide-propylene oxide condensates on primary alkanols, such a PLURAFACS (BASF, New Jersey, USA) and condensates of ethylene oxide with sorbitan fatty acid esters such as the compositions available under the various TWEENS tradenames, available from ICI Surfactants (New Jersey, USA). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements.

The nonionic detergent class includes the condensation products of a higher alcohol (e.g., an alkanol containing 8 to 18 carbon atoms in a straight or branched chain configuration) condensed with about 5 to about 30 moles of ethylene oxide, for example, lauryl or myristyl alcohol condensed with about 16 moles of ethylene oxide (EO), tridecanol condensed with about 6 moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

In certain embodiments, the nonionic surfactants are the Neodol ethoxylates (available from Shell Co., USA), which are higher aliphatic, primary alcohol containing 9 to 15 carbon atoms, such as $C_9$-$C_{11}$ alkanol condensed with 2.5 to 10 moles of ethylene oxide (NEODOL 91-2.5 or -5 or -6 or -8), $C_{12}$-$C_{13}$ alkanol condensed with 6.5 moles ethylene oxide (Neodol 23-6.5), $C_{12}$-$C_{15}$ alkanol condensed with 12 moles ethylene oxide (Neodol 25-12), $C_{14}$-$C_{15}$ alkanol condensed with 13 moles ethylene oxide (Neodol 45-13), and the like. In certain embodiments, the nonionic surfactant component is a mixture of Neodol 91-8 and Neodol 91-2.5 in the range of about 7:1 to about 3:1 weight ratio.

In certain embodiments, the nonionic system comprises the mixture of a nonionic surfactant formed from a $C_9$-$C_{11}$ alkanol condensed with 2 to 3.5 moles of ethylene oxide ($C_9$-$C_{11}$ alcohol EO 2 to 3.5:1) with a nonionic surfactant formed from a $C_9$-$C_{11}$ alkanol condensed with 7 to 9 moles of ethylene oxide ($C_9$-$C_{11}$ alcohol EO 7 to 9:1), wherein the weight ratio of the $C_9$-$C_{11}$ alcohol EO 7 to 9:1 to the $C_9$-$C_{11}$ alcohol EO 2 to 3.5:1 is, in various embodiments, about 8:1 to about 1:1, or about 7:1 to about 3:1.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$-$C_{15}$ secondary alkanol condensed with either 9 EO (available under the tradename "TERGITOL 15-S-9") or 12 EO (available under the tradename "TERGITOL 15-S-12") marketed by Union Carbide (USA).

Other suitable nonionic detergents include the polyethylene oxide condensates of one mole of alkyl phenol containing 8 to 18 carbon atoms in a straight- or branched chain alkyl group with about 5 to about 30 moles of ethylene oxide. Specific examples of alkyl phenol ethoxylates include nonyl phenol condensed with about 9.5 moles of EO per mole of nonyl phenol, dinonyl phenol condensed with about 12 moles of EO per mole of phenol, dinonyl phenol condensed with about 15 moles of EO per mole of phenol and di-isoctylphenol condensed with about 15 moles of EO per mole of phenol. Commercially available nonionic surfactants of this type include those available under the tradename "IGEPAL CO-630" (nonyl phenol ethoxylate) marketed by GAF Corporation (USA).

Also among the satisfactory nonionic detergents are the water-soluble condensation products of a $C_8$-$C_{20}$ alkanol with a heteric mixture of ethylene oxide and propylene oxide wherein the weight ratio of ethylene oxide to propylene oxide is about 2.5:1 to about 4:1, preferably about 2.8:1 to about 3.3:1, with the total of the ethylene oxide and propylene oxide (including the terminal ethanol or propanol group) being 60-85%, preferably 70-80%, by weight. Such detergents are commercially available from BASF-Wyandotte and a particularly preferred detergent is a $C_{10}$-$C_{16}$ alkanol condensate with ethylene oxide and propylene oxide, the weight ratio of ethylene oxide to propylene oxide being 3:1 and the total alkoxy content being about 75% by weight.

Condensates of 2 to 30 moles of ethylene oxide with sorbitan mono- and tri-$C_{10}$-$C_{20}$ alkanoic acid esters having a hydrophilic-lipophilic balance (HLB) of about 8 to about 15 also may be employed as the nonionic detergent ingredient in the described composition. These surfactants are known and are available from Imperial Chemical Industries (New Jersey, USA) under the TWEEN trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

Other suitable water-soluble nonionic detergents are marketed under the trade name PLURONICS (available from BASF, New Jersey, USA). The compounds are formed by condensing ethylene oxide with a hydrophobic base formed by the condensation of propylene oxide with propylene glycol. The molecular weight of the hydrophobic portion of the molecule is of the order of 950 to 4000 and preferably 200 to 2,500. The addition of polyoxyethylene radicals to the hydrophobic portion tends to increase the solubility of the molecule as a whole so as to make the surfactant water-soluble. The molecular weight of the block polymers varies from about 1,000 to about 15,000 and the polyethylene oxide content may comprise about 20% to about 80% by weight. Preferably, these surfactants will be in liquid form and satisfactory surfactants are available as grades L 62 and L 64. In certain embodiments, useful nonionics include alkyl polyglucosides.

In certain embodiments, the compositions of the present invention may further comprise an organic solvent. Organic solvents that can be used in the composition include alcohols and ethers, for example glycols or alkoxylated glycols, alkoxylated aromatic alcohols, aromatic alcohols, linear alcohols, or other glycol ethers; e.g., $C_{1-4}$ alcohols, e.g., ethanol or isopropanol, and glycol ethers and diethers, especially $C_{1-6}$ alkyl ethers of propylene glycol or dipropylene glycol, for example dipropyleneglycol monobutyl ether, propylene glycol n-butyl ether, and mixtures thereof. In certain embodiments, the solvents are present in a 1:1:1 mixture of dipropylene glycol mono-butyl ether, propylene glycol n-butyl ether and ethanol. In various embodiments, this organic solvent may be present an amount by weight of about 1 to about 6%, about 2 to about 5%, about 2.5 to about 4% or about 3% of the cleaning compositions.

Additional optional ingredients may be included to provide added effect or to make the product more attractive to consumers. Such ingredients include perfumes or fragrances, colorants such as pigments or dyes, additional thickening or abrasive agents, disinfectants, radical scavengers, hydrotropes, bleaching agents, chelating agents, or mixtures thereof.

The compositions of the present invention may be dispensed by any means known in the art of cleaning compositions. For example, in certain embodiments, the compositions may be dispensed by a spray bottle to the area to be cleaned. Optionally, the pump on the spray bottle may have a foaming mechanism so that the formulation is dispensed in the form of a foam. Accordingly, in various embodiments, the invention further provides a non-aerosol container containing the composition and having a spray pump so that the composition can be sprayed on the surface to be cleaned, e.g., wherein the spray pump is a foam-generating pump so that the formulation can be dispensed in the form of a foam.

Unless otherwise stated, all percents described in the examples and elsewhere in this application are in weight percents based on the total formulation as 100%. All tests and measurements are performed at room temperature and pressure unless otherwise stated. The examples and other statements of preferred ingredients, formulations and utilities are intended to illustrate rather than to limit the invention.

Example 1

Tables 1 and 2 illustrate some compositions of the described invention (Formulas A through H). Unless otherwise specified, all percentages are by weight.

TABLE 1

| Component | Formula A (Weight %) | Formula B (Weight %) | Formula C (Weight %) | Formula D (Weight %) |
|---|---|---|---|---|
| Phosphoric acid | 2 | 2 | 3 | 3 |
| Lactic acid | 3 | 3 | 3 | 3 |
| C9-C11 alcohol EO 7.5-8:1 | 2.5 | 2.5 | 3 | 3 |

TABLE 1-continued

| Component | Formula A (Weight %) | Formula B (Weight %) | Formula C (Weight %) | Formula D (Weight %) |
|---|---|---|---|---|
| C9-C11 alcohol EO 2-3.5:1 | 0 | 0 | 0 | 0.5 |
| Polymer | 0.2 | 0.2 | 0.2 | 0.2 |
| Solvent | 0 | 0 | 3 | 3 |
| Hydrotrope (Solubilizer) | 0 | 0 | 0 | 0.4 |
| Perfume | 0.4 | 0.4 | 0.4 | 0.4 |
| Thickener | 0.5 | 0.0 | 0.25 | 0 |
| Water | q.s. | q.s. | q.s. | q.s. |

TABLE 2

| Component | Formula E (Weight %) | Formula F (Weight %) | Formula G (Weight %) | Formula H (Weight %) |
|---|---|---|---|---|
| Oxalic acid | 0.5 | 0.5 | 1.0 | 1.0 |
| Formic acid | 2.0 | 2.0 | 2.5 | 2.5 |
| C9-C11 alcohol EO 7.5-8:1 | 2.5 | 3.0 | 2.5 | 3.0 |
| C9-C11 alcohol EO 2-3.5:1 | 0 | 0.5 | 0 | 0.5 |
| Polymer | 0.2 | 0.2 | 0.2 | 0.2 |
| Hydrotrope (Solubilizer) | 0 | 0.4 | 0 | 0.4 |
| Solvent | 0 | 3 | 0 | 3 |
| Perfume | 0.4 | 0.4 | 0.4 | 0.4 |
| Thickener | 0.25 | 0 | 0.5 | 0 |
| Water | q.s. | q.s. | q.s. | q.s. |

The compounds of Formulas A to H demonstrated excellent performance in lime scale, artificial feces and soap scum prevention, have a clear activity against rust, while still retaining substantial effectiveness against grease.

What is claimed is:

1. A cleaning composition comprising:

(a) formic and oxalic acids in a weight ratio of about 2:1 to about 5:1;

(b) a nonionic surfactant comprising an ethoxylated alcohol; and (c) a polybetaine.

2. The cleaning composition of claim 1, wherein:

the nonionic surfactant comprises a $C_9$-$C_{11}$ alcohol with a degree of ethoxylation of about 7 to about 9.

3. The composition of claim 1, wherein the nonionic surfactant is a $C_9$-$C_{11}$ alcohol with a degree of ethoxylation of about 7.5 to about 8.1.

4. The composition of claim 1, further comprising an inorganic acid chosen from phosphoric acid, nitric acid, hydrochloric acid and sulfuric acid.

5. The composition of claim 1, wherein the total amount of acid present is between about 4 and about 7.5% of the composition.

6. The composition of claim 5, wherein the total amount of acid present is between about 4.5 and about 7% of the composition.

7. The composition of claim 1, further comprising a thickener comprising xanthan gum, gellan gum, carrageenan gum, hydroxyethylcellulose and mixtures thereof.

8. A composition useful for cleaning a bathroom or kitchen surface, comprising:

(a) formic and oxalic acids in a weight ratio of about 2:1 to about 5:1;

(b) a nonionic surfactant comprising a $C_9$-$C_{11}$ alcohol with a degree of ethoxylation of about 7.5 to about 8.1;

(c) about 0.1 to about 1% of an anti-adhesion polymer comprising a polybetaine;

(d) optionally a thickener comprising xanthan gum, gellan gum, carrageenan gum, hydroxyethylcellulose; and (e) about 85 to about 95% water;

wherein the pH of the composition is 0 to about 3.

9. A cleaning system comprising the composition of claim 1 contained within a jug or spray bottle.

10. A method of removing soil or limescale from a hard surface comprising applying the composition of claim 1 to the hard surface and rinsing or wiping the hard surface.

11. The method of claim 10, wherein the hard surface is the surface of a toilet.

12. A method of disinfecting a hard surface comprising applying the composition of claim 1 to the surface and rinsing or wiping the surface.

13. A method of preventing soil adhesion to a hard surface comprising applying the composition of claim 1 to the surface and rinsing or wiping the surface.

14. A method of imparting shine to a hard surface comprising applying the composition of claim 1 to the hard surface.

15. A cleaning system comprising a non-aerosol container containing the composition of claim 1 and comprising a spray pump for dispensing the composition.

16. The cleaning system of claim 15, wherein the spray pump is a foam-generating pump, allowing the composition to be dispensed in the form of a foam.

17. A method of removing a soil from a surface comprising the step of applying the composition of claim 1 onto the hard surface, and rinsing or wiping the surface.

18. The method of claim 17, wherein the soil is chosen from grease, limescale, soap scum or feces.

19. A method of preventing the adhesion of a soil to a hard surface, comprising the step of applying the composition of claim 1 onto the hard surface, and rinsing or wiping the hard surface.

* * * * *